US005086845A

United States Patent [19]

Baugh

[11] Patent Number: 5,086,845

[45] Date of Patent: Feb. 11, 1992

[54] LINER HANGER ASSEMBLY

[75] Inventor: J. Lindley Baugh, Houston, Tex.

[73] Assignee: Baker Hughes Incorporated, Houston, Tex.

[21] Appl. No.: 545,612

[22] Filed: Jun. 29, 1990

[51] Int. Cl.[5] ..... E21B 23/00

[52] U.S. Cl. ..... 166/382; 166/206; 166/212; 166/217; 166/208

[58] Field of Search ..... 166/382, 206, 208, 212, 166/217, 134

[56] References Cited

U.S. PATENT DOCUMENTS

| | | | |
|---|---|---|---|
| 2,698,058 | 12/1954 | Page | 166/212 |
| 3,223,170 | 12/1965 | Mott | 166/208 |
| 3,318,384 | 5/1967 | Brown | 166/134 |
| 4,010,804 | 3/1977 | Garcia | 166/208 |
| 4,311,196 | 1/1982 | Beall et al. | 166/134 |
| 4,437,517 | 3/1984 | Bianchi et al. | 166/212 |
| 4,688,642 | 8/1987 | Baker | 166/212 |
| 4,926,938 | 5/1990 | Lindsey, Jr. | 166/212 |

*Primary Examiner*—Bruce M. Kisliuk
*Attorney, Agent, or Firm*—Melvin A. Hunn

[57] ABSTRACT

A liner hanger assembly is disclosed for setting within a casing conduit and carrying a liner string therebelow. The assembly has slip elements for gripping the casing with each of the slip elements having symmetrically angled teeth such that only one set of slips may be used to anchor the hanger and liner in position against relative longitudinal movement in either direction subsequent to setting. The apparatus is hydraulically settable and provides for application of workstring load to the apparatus to direct additional load in excess of that required to set the slips in anchoring engagement. The housing of the apparatus and the liner therebelow also may be rotated by the tubular workstring subsequent to setting without effecting rotational movement of the slip elements.

13 Claims, 3 Drawing Sheets

LINER HANGER ASSEMBLY

BACKGROUND OF THE INVENTION

1. Field of the Invention

The invention relates to a liner hanger apparatus for use in carrying and setting a casing liner within an enlarged diameter casing section within a subterranean well.

2. Description of the Prior Art

Subsequent to the drilling of a subterranean oil or gas well, metallic casing is run into the well and cemented into place therein. The casing string normally comprises telescoping sections, the sections being of considerable length relative to the depth of the well. As the well depth increases, the internal diameter of the casing sections will become smaller such that they are positioned in the well in somewhat telescopic mode. Each of the casing sections below the first or main casing is called a "liner" and is run into the well within the casing on a tubular workstring with the liner being set immediate the lowermost end of the casing by means of a "liner hanger". Typically, such liner hangers are either mechanically actuated and/or hydraulically actuated and comprise a slip mechanism to grasp the interior wall of the casing such that the hanger is in gripping engagement with the casing and the liner extends below the hanger and is secured to the lowermost end thereto.

Recent technological advances have contributed to the successful concept of horizontal drilling and completion operations. In past vertical well operations, it has been necessary for the liner hanger to only hold longitudinal movement of the liner and/or workstring (while it is secured to the hanger) against movement in one direction, i.e. downward movement, attributable to the weight carried through the hanger by the length of the extending liner therebelow. However, in the case of horizontal wells, as well as in some other well applications, it becomes necessary for the liner hanger to hold in both directions.

In the past, those skilled in the art have provided liner hangers having two sets of slip assemblies, one slip assembly holding the hanger and resisting movement in one direction while the other slip assembly has held the liner hanger and prevented movement in the other direction. The provision of plural sets of slips not only is costly, but contributes to the weight and complexity of the apparatus and the various setting mechanisms utilized to set such slips. In such instances, while such slip assemblies have been designed to be satisfactory, such design must take careful consideration of the setting mechanism and procedure to assure that both sets of slip elements are properly and completely set to assure that there is no imbalance between the respective sets with respect to the holding.or gripping action relative to the casing.

Regardless of the slip assembly configuration in liner hangers, when the hangers are hydraulically actuated, the slip assembly will only receive approximately 5 to 6 thousand p.s.i. of force, which is the maximum force which can be transmitted through the tool by means of application of hydraulic pressure through the workstring and the interior of the liner hanger. In contrast, hangers which are actuated into set condition by means of mechanical manipulation of the tubular workstring, either longitudinally and/or rotationally, can receive from between 50 to 100 thousand pounds of load through the slip assembly.

In the past, those skilled in the art have been unable to manipulate a tubular workstring into rotational movement while also preventing movement in both directions. In some instances in completion operations, it would be desirable to permit the workstring to rotate through the liner hanger to transmit torque through the liner conduit to activate valves, float shoes, or the like during cementing and other completion and remedial operations.

The present invention is directed to providing a liner hanger apparatus which remedies the problems in prior art devices, as above described.

In U.S. Pat. No. 4,750,563, entitled "Slip Gripping Mechanism With Automatic Segment Alignment", and assigned to Hughes Tool Company, a predecessor entity to Applicant's assignee, there is shown and disclosed a slip gripping mechanism which can be utilized in a hanger assembly. Additionally, in U.S. Pat. No. 4,711,326, entitled "Slip Gripping Mechanism", also assigned to Hughes Tool Company, a predecessor entity of the assignee of the present invention, there is shown and disclosed a slip assembly which is similar to that of the present invention and which can be adapted for use in liner hangers. However, neither of these slip assemblies will hold the assembly in set condition against movement in both directions as a result of force being applied across the tool from bottom to top or top to bottom. Additionally, neither of these devices is initially moved to set condition by means of hydraulic actuation with subsequent mechanical load being applied to the set slip assembly. Furthermore, neither of these prior art devices contemplate incorporation into a hanger which may be rotated to rotate the liner section carried therebelow without rotational effect upon the set slip assembly which is in gripping engagement with the interior wall of the casing conduit.

SUMMARY OF THE INVENTION

The present invention provides a hanger assembly which is securable to a workstring for carrying a liner conduit into a subterranean well. In one embodiment, the hanger assembly comprises an elongated tubular housing. A series of circumferentially extending slip elements are carried exteriorly around and by the housing and are movable from a retracted position to an expanded position for gripping engagement with the casing string. Each of the slip elements has a series of circumferentially subscribed exteriorly protruding non-buttress teeth which are defined thereon, the teeth being symmetrical to both push and pull forces applied through the assembly by either the workstring or the liner conduit subsequent to setting within the casing string.

In another embodiment, a hanger assembly is provided which is moved to set position relative to the casing by application of hydraulic pressure in a first pre-determined amount to transmit and apply a setting load to a slip assembly and pressed condition by mechanical manipulation of the workstring subsequent to moving the assembly to the set position to transmit a second load to the slip elements in excess of the setting load, and further comprises locking means for locking the setting and second loads into the slip assembly.

In another embodiment, a liner hanger assembly is provided which has bearing means to permit rotation of the housing without rotation of the slip elements subsequent to setting of the liner hanger assembly in the casing string.

DESCRIPTION OF THE PREFERRED EMBODIMENTS

Figure 1:
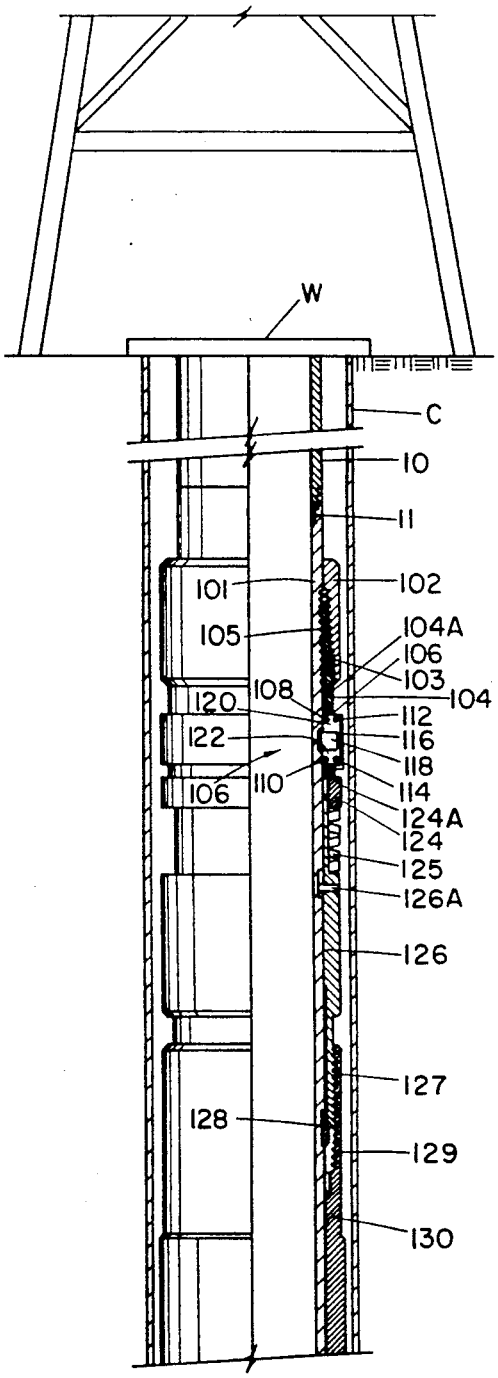
FIG. 1 is a one-quarter longitudinal section view of an upper portion of the liner hanger of the present invention, prior to being set.
Figure 2:
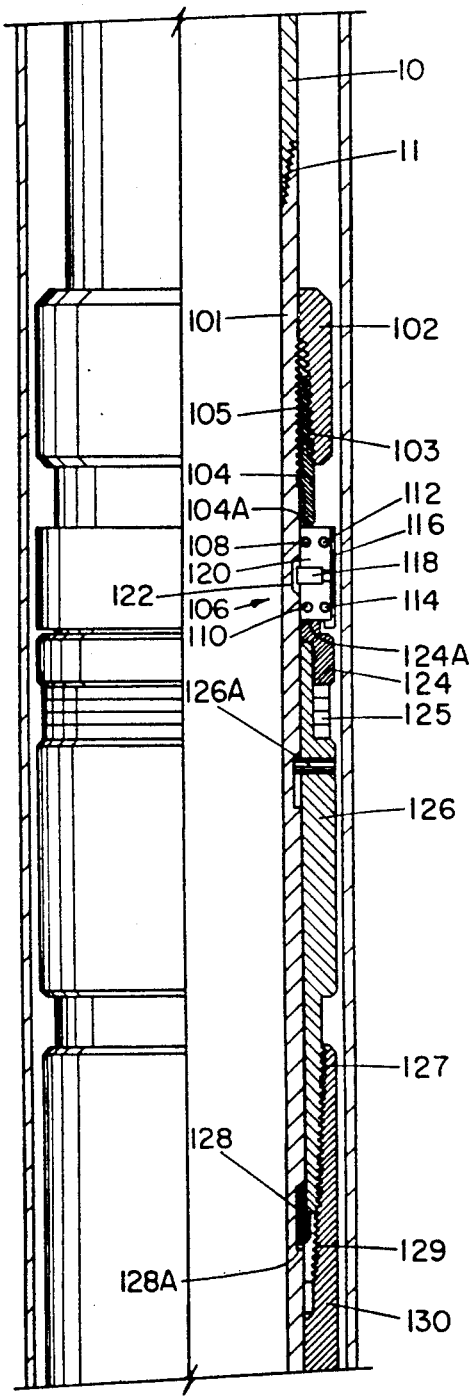
FIG. 2 is a one-quarter longitudinal section view of the upper portion of the liner hanger of the present invention, which corresponds to FIG. 1, showing the liner hanger in a set position.

Now with first reference to FIG. 1 and 2 there is shown the liner hanger apparatus 100. The apparatus 100 is carried into the well W on a tubular workstring 10 which is securted at threads 11 to the uppermost end of an inner cylindrical housing 101. As shown, the apparatus 100 is positioned at the lowermost end of a casing string C and carries a length of liner conduit L at its lowemost end and secured to the lower end of the inner cylindrical housing 101 at threads 12.

Since the apparatus 100 as shown as set by application of hydraulic pressure through the workstring 10, a sealing ball seat 13 is carried interiorly of the uppermost end of the liner conduit L and secured thereto by means of a shear pin 14, or the like, for sealing receipt of a ball element 15, for which a plug could be subsituted which is pumped or gravitated through the interior of the workstring 10 when it is desired to set the apparatus 100 at the preselected depth. After the setting operation, hydraulic pressure is increased over the amount required to fully set the apparatus 100, in order to shear the pin 14 and drop the ball seat 13 to the bottom of the conduit L, together with the sealing ball 15.

Below the threads 11 and circumferentially extending around the exterior of the inner cylindrical housing 101 is a lock ring housing 102 having threads 103 around its interior for threaded engagement with companion threads carried on a lock ring 104 which, in turn, is secured by means of threads 105 to the inner cylindrical housing 101. The lock ring 104 has its lowermost abutting end 104a in contact with the uppermost endor face of a bearing race 120 which houses a bearing element 118, such as a roller bearing. The bearing element 118, extends within a bearing race 122 which is defined around the exterior of the inner cylindrical housing 101.

It will be appreciated that the provision of the bearing element 118 and bearing races 120 and 122 will permit rotation of the workstring 10 and inner cylindrical housing 101 together with the lock ring housing 102, but prevent such rotational movement through the bearing element 118 to the exterior slip seat, slip element, and T-slot ring assembly to be hereinafter defined. The bearing element 118 is secured within the bearing races 120 and 122 by means of an outer cap 116, with elastomeric upper and lower debris barriers 108 and 110 being housed within the bearing races 120 and 122 carried circumferentially around the exterior of the inner cylindrical housing 101 above and below the bearing element 118. Similar elastomeric debris barriers 112 and 114 are carried around the exterior of the bearing races 120 and 122 between the races 120 and 122 and the interior of the outer cap 116. Thus, the first bearing means 106 has been described.

The first bearing means 106 acts in concert with the second bearing means 107 which is carried below the lowermost end of a T-slot ring assembly 136 below the lowermost end of the slip element 132 (shown in FIG. 3). The second bearing means 107 comprises a bearing element 119 carried within the second bearing race 121 and circularly relatively movable around a bearing race 123 defined through the uppermost end or bearing-carrying portion 143 of a lower bearing housing 144.

Upper and lower elastomeric debris barriers 109, 111 are carried within the bearing race 121 and 123 around the exterior of the bearing carrier portion 143. Similarly, debris barriers 113 and 115 are carried around the exterior of the bearing races 121 and 123 for contact with the interior of the outer cap 117 to keep debris out of the second bearing means 107. Thus, the first and second bearing means 106, 107 serve to permit rotation or torque to be applied through the workstring 10 and the inner cylindrical housing 101 to the lower bearing housing 144 and lower components secured thereto, thence through the threads 12 to the liner conduit without rotation of the slip elements and component parts carried exterior of the inner cylindrical housing 101 between the first and second bearing means 106, 107.

The upper face of the first bearing means 106 receives the lower end 104a of the lock ring 104 with the lock ring 104 movable relative to the housing 101 and lock ring housing 102 during makeup of the apparatus 100 to secure tight connection relative to the first bearing means 106.

The upper end 124a of a bearing cap 124 contacts the lowermost face of the bearing race 120 of the first bearing means 106. Extending around the lowermost end of the cap 124 and housed exterior of top of a spacer 126 is a series of compressible belleville spring elements 125.

A shear pin 126*a* extends through the spacer 126 and is received within a shear pin groove 126 *b* within the inner cylindrical housing 101 to prevent rotation of the componenets carried exterior of the cylindrical housign 101 relative to such housing 101 prior to setting. Ideally after liner hanger apparatus 100 is fully set, pin 126*a* may be sheared to allow rotation of workstring 10, inner cylindrical housing 101, and liner conduit L relative to engaged slip elements 132 in casing string C.

The spacer 126 is secured by means of threads 127 in inner engagement with companion threads 129 upon a longitudinally extending slip seat 130, with a retainer ring element 128 held within a retainer ring groove 128*a* around the inner cylindrical housing 101 to secure the spacer 126 into locked position relative to the belleville springs 125 during assembly.

Figure 3:
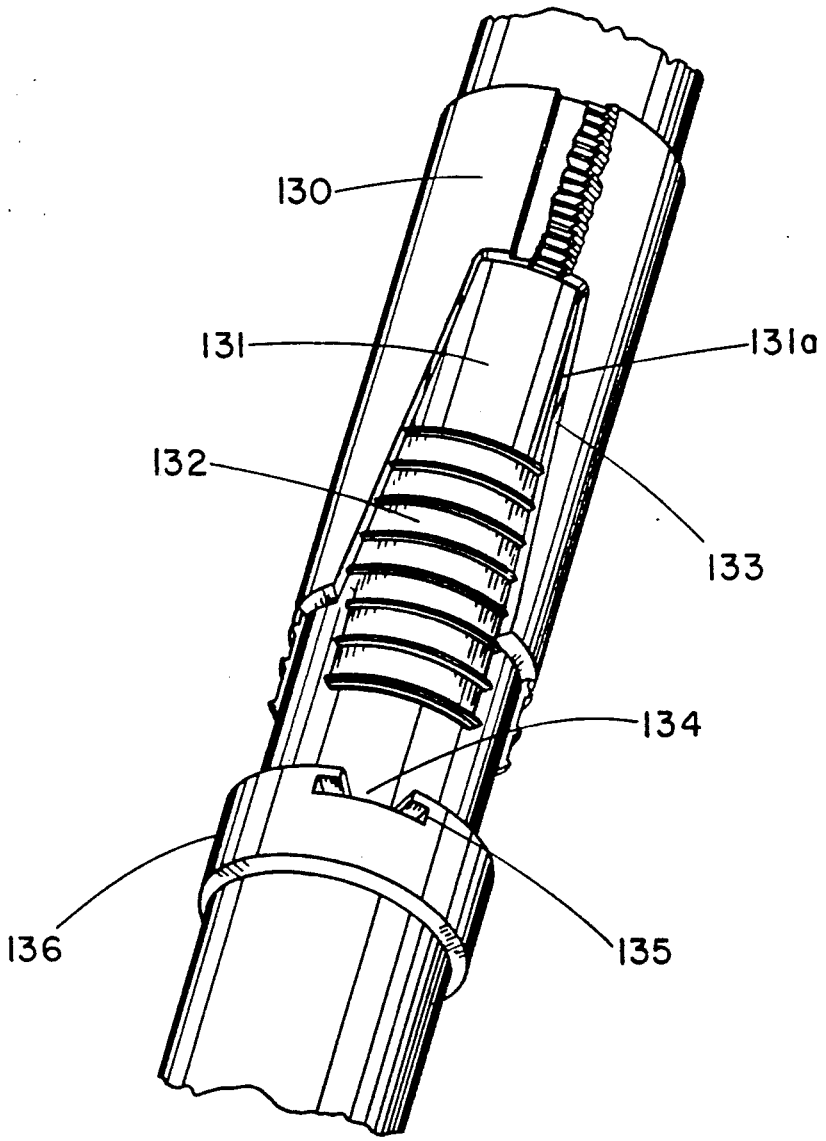
FIG. 3 is a perspective view of a portion of the liner hanger of the present invention, depicting the slip element thereof.

With reference now to FIG. 3 slip seat 130 has an opening or window 131 defined therethrough for a series of circumferentially extending slip elements 132 with side wall portions 131*l* defined within the slip seat 130 around the opening 131 such that as the slip elements 132 are moved relative to the slip seat 130 during the setting procedure, the slip elements 132 expand outwardly into gripping engagement along the inner wall of the casing conduit C.

Each slip element 132 has at one end thereof a clutch means which comprises a T element 134 carried on the lower-most end of the slip element 132 for interengagement within a T-slot member 135 defined at the uppermost end of a T-slot ring 136 carried around the exterior of the housing 101.

Figure 1A:
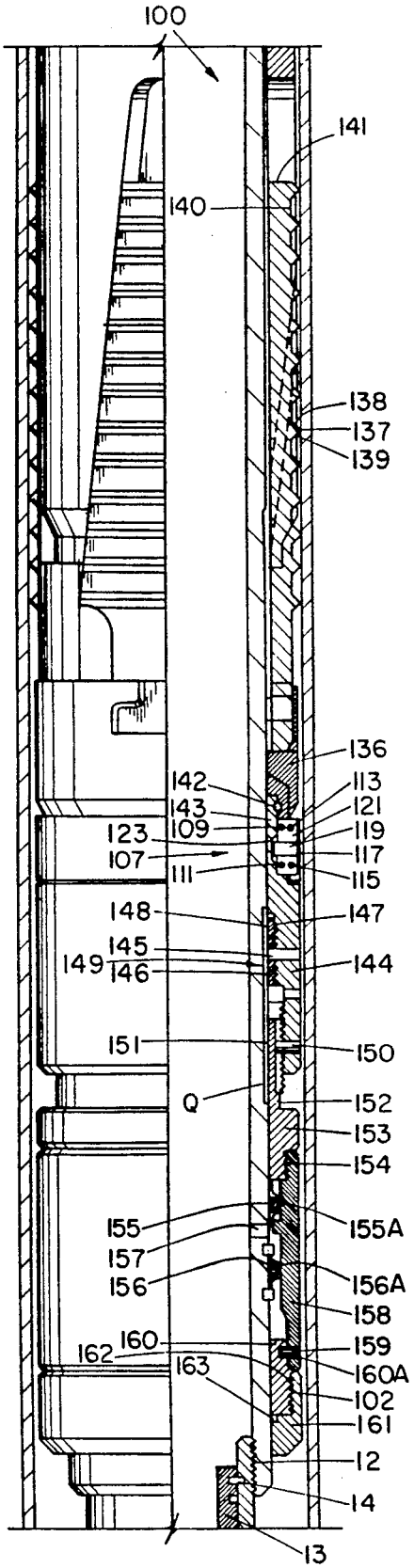
FIG. 1*a* is a one-quarter longitudinal section view of a lower portion of the liner hanger of the present invention, prior to being set.
Figure 2A:
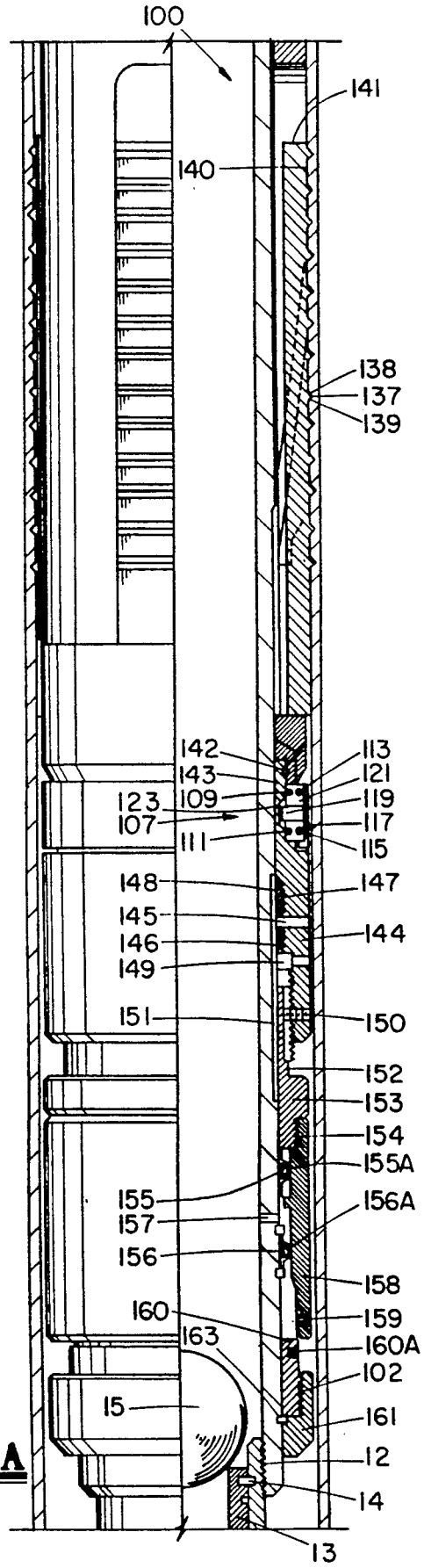
FIG. 2*a* is a one-quarter longitudinal section view of the lowe portion of the liner hanger of the present invention, corresponding to FIG. 1*a*, showing the liner hanger in a set position.

Each of the slip elements 132 has a series of teeth 132*a* for gripping engagement with the wall of the casing C. With reference to FIGS. 1A and 2A, each of the teeth 132*a* has an outermost tip 137 which is formed by a top arc 138 and a bottom arc portion 139, with the arcs 138 and 139 preferably being 90° offset relative to one another and extending from a longitudinal axial line or valley 140 of the slip assembly with the valley 140 extending below each of teh respective tips 137. Each of the slips has a first end 141 extending toward the workstring 10 as well as a second or lower end 141*a* facing away from the slip seat 130 and toward the liner conduit L.

the lowermost end of the T-slot ring assembly 136 has a circumferentially extending swivel ring element 142 extending within a companion profile on a bearing carrier portion 143 of the bearing housing 144.

A ratchet assembly 149 is formed betwen a set of circumferentially extending mandrel teeth 148 on the external diameter of inner cylindrical housing 101, and a set of companion ratchet teeth 147 on the interior diameter of body lock ring 146. The bidy lock ring 146 has buttress teeth 146*a* on its exterior to mate with threads on the ID of bearing housing 144, and is held in position relative to housing 144 by means of drive pin 145.

Lower bearing housing 144 is held in position relative to a packing retainer 153 by a set screw 150. A square key element 151 is provided which protrudes into the interior of the lowermost end of the lower bearing housing 144 and positioned in slot Q to prevent the housing 101 from rotating relative to the bearing housing 144 when the hanger is rotated, with the key 151 extending between upper slotted ends 152 of a packing retainer 153 which, in turn, is secured at threads 154 to the hydraulic cylinder 158.

The hydraulic cylinder 158 houses a series of first and second seal assemblies 155, 156. Seal assemblies 155 and 156 enclose an annular space between the lower hydraulic cylinder 158 and the inner cylindrical housing 101 to form a hydraulic piston-tupe chamber which receives through a hydraulic pressure port 157 hydraulic pressure held within the apparatus 100 above the sealing ball 15 during the hydraulic setting of the hanger assembly 100.

A shear pin 159 extends through the lowermost end of the hydraulic cylinder 158 to secure the cylinder 158 and its associated parts relative to the housing 101 prior to the setting of the apparatus 100. The shear pin 159 extends internally within a groove 160*a* defined around the uppermost exterior of a gauge ring retainer 160 housed between the cylinder 158 and the lowermost end of housing 101. The gauge retainer 160 is secured at threads 162 to a gauge ring 161 with a snap ring 163 extending bwetween the ring 161 and the housing 101 to define the lowermost end of the apparatus 100.

OPERATION

When it is desired to set the liner conduit L within the casing C, the apparatus 100 is assembled upon the lowermost end of the workstring 10 by securement at the threads 11, and the liner conduit L is secured at its uppermost end to the lower end of the inner cylindrical housing 101 at threads 12. The ball seat 13 is secured in place by means of the shear pin 14.

The apparatus 100 is lowered into the well W inside the casing string C by means of the workstring 10 until it is positioned at rthe desired location, which typically will be at the lowermost end of the casing string C. With the apparatus 100 in position in the well, a sealing ball 15 is gravitated or pumped through the interior of the workstring 10 until it comes into sealing engagement upon the ball seat 13. Now, pressure is increased within the interior of the workstring 10 and the interior of the inner cylindrical housing 101 of the apparatus 100 above the ball 15 and is applied through the hydraulic pressure setting port 157 to act on the effective piston area defined by the annular space between sealing assemblies 155 and 156. As pressure is increased, the shear pin 159 will become disengaged relative to the gauge ring retainer 160, enabling the hydraulic cylinder 158, packing retainer 153, sel assembly 155, lower bearing housing 144, T-slot ring 136 and the slip elements 132 to move axially toward the slip seat 130 which is indirectly secured to the stable inner cylindrical housing 101. Increased pressure will cause such movement to continue causing the slip elements 132 to be radially displaced away from the inner cylindrical housing 101 such that the teeth 132a come into gripping engagement with the inner smooth wall of the casing C.

In a conventional setting procedure, the maximum amount of hydraulic pressure which can typically be transmitted and applied to the slip elements to effect setting within the casing C will be approximately 5 to 6 thousand p.s.i. The present invention affords means for further application of setting force to the slip elements by application of mechanical force, or secondary compressive biasing means, subsequent to hydraulic actuation of the settinh load After the desired hydraulic pressure has been delivered to the apparatus 100 for setting, as described, the weight on the workstring 10 is slacked off at the top of the well thus permitting the entire weight of the workstring 10 above the apparatus 100 as well as the weight of the liner L therebelow to effectively be delivered to the slip assembly. Such weight is transmitted from the inner cylindrical housing 101 through the lock ring 104 to the first bearing means 106, through the bearing cap 124 for compression of the belleville springs 125 and the spacer 126 to urge the slip seat 130 toward the slip elements, further urging the teeth 132a into secured engagement with the inner wall of the casing C.

This mechanical secondary actuation,or secondary compressive biasing means, will enable an additional 50 to 100 thousand pounds of force to be available to urge and retain the slip seat 130 relative to the slip elements 132.

As hydraulic and mechanical force is applied through the apparatus 100 during the setting procedure, the top and bottom arcs 138, 139 of the teeth 132*a* will become substantially embedded within the casing C such that the 90° profile of the top arc 138 will resist mechanical movement of the apparatus 100 relative to the casing C in a direction toward the work-string 10, while the 90° profile of the bottom arc 139 will, in turn, resist mechanical movement of the apparatus 100 in a direction of the liner conduit L.

Subsequent to setting, hydraulic pressure may be applied to shear the shear pin 14 to release the ball seat 13 and sealing ball 15 from setting position, in known fashion.

It will be appreciated that as the hydraulic and mechanical setting procedure is effected, the force delivered to the slip elements is retained therein by the ratcheting between the ratchet teeth 147 and the mandrel teeth 148 to prevent movement of the inner cylindrical housing 101 and the exterior components of the slip assembly toward the retracted and running position into the well, as shown in FIG. 1.

Subsequent to setting, as above described, shear pin 126*a* may be sheared and the work-string 10 and liner conduit L may be rotated relative to the set slip assembly means or torque applied through the bearing means 106, and 107.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. A hanger assembly securable to a workstring for carrying a liner conduit in a subterranean well and settable withi a casing string, comprisng:

(1) an elongated tubular housing;

(2) a series of circumferentailly extending slip elements carried exteriorly around and by said housing and axially movable relativve to a slip seat from a radially retracted position to a radially expanded position for gripping engagement with the casing string; and (3) each of said slip elements having circumferentially subscribed exteriorly protruding non-buttress teeth defined thereon, said teeth being symmetrical to both pus and pull forces applied through the assembly by either the workstring or the liner conduit subsequent to setting within said casing string;

(4) wherein said assembly is moved to a set position relative to said casing string by application of hydraulic pressure in a first predeterminable amount to transmit and apply a setting load to said slip elements;

(5) and further comprising compressive biasing means movable to a compressed condition by mechanical manipulation of said workstring subsequent to movement of said assembly to said set positon to transmit a second load to said slip elements in excess of the setting load; and (6) locking means for locking the setting and second loads into said slip assembly,

2. The hanger assembly of claim 1 wherein each of said teeth have top and bottom arches each offset 90° from one another abnd extending to a respective outer tip of each of said teeth.

3. The hanger assembly of claim 1 wherein the teeth on each of said slip elements are at one end of said slip element and wherein the other end of each of said slip elements comprises clutch means for expansive engagement relative to said housig, said other end of each of said slip elements facing said liner conduit.

4. The liner hanger of claim 1, 2 or 3, said assembly beingmoved to set positve relative to said casing string by application of hydraulic pressure in a first pre-determinable amount to transmit and apply a setting load to said slip elements, and further comprisign compreseive biasing means movable to a compressed condition by mechanical manipulation of said workstring subgsequent to movement of saidf assembly to said set postion to transmit a second load to said slip elements in excess of the setting load, and locking means for locking the setting and second loads into said slip assembly.

5. The hanger assembly of claim 1 wherein said locking means comprises a one-way ratchet assembly including a lock ring disposed extderiorly around said housing with lock wickers on said lock ring facing said housing for ratcheting engagement along companion wickers defined around the exterior of said housing.

6. The hanger assembly of claim 1,2, or 3 further comprising bearing means disposed above and below said slip elements to permit rotation of said housign without rotation of said slip elements subsequent to setting of said hanger assembly in said casing string.

7. A hanger assembly securable tyo a workstring for carrying a liner conduit in a subterranean well and settable with in casing string, comprising:

(1) an elongated tubjular housing;

(2) a series of circumferentially extending slip elemtns carried exteriorly around and by said housing and movable from a trtracted position to an expanded position for gripping engagement with the casing string;

(3) each of said slip elements having circumferentially subscribed exteriorly protruding non-buttress teeth defined thereon, said teeth being symmetrical to both push and pull forces applied through the assembly by either the workstring or the liner conduit subsequent to setting with said casing string, said teeth having top and bottom arches each offset 90° from a valley between said teeth and extending to a respective outer tip of each said teeth, said teeth being at one end of each of said slip elements;

(4) clutch emans at the other end of said slip elements for expansive engagement relative to said housign, said other end of said slip elements facing said liner conduit, said hanger assembly being moved to set postion relative4 to said casing string by application of hydraulic pressure in a first predterminable amount to transmit and apply a setting load to said slip elemtns;

(5) compressive biasing means movable to a compressed condition by mechanical mani0pulation of said workstring subsequent to movement of said assembly to said set position to transmit a second load to said slip elements in excess of the setting load;

(6) locking means for locking the setting and second loads into said slip assemble, said locking means comprisng a one-way ratchet assembly including a lock ring disposed exteriorly around said housing with wickers thereon facing said housing ratcheting engagement along companion wickers defined around the exterior of said housing; and (7) bearing means disposed above and below said teeth to permit rotation of said housing both above and below said teeth without rotation of said slip element subsequent to setting of said apparatus in said casing string.

8. A method of positgioning a casing liner within a casing string in a subterranean well, comprising the steps of:

(a) secruing at the top of the well to a tubular workstring a liner hanger assembly, said assembly comprising:

(1) an elongated tubular housing;

(2) a series of circumferentially extending slip elements carried exteriorly around and by said housing and axially movable relative to a slip seal from a radially retracted position to a radially expanded position for gripping engagement with the casing string; and (3) each of said slip elements having circuferentially exteruirkt ariybd abd by subscribed exteriorly protruding non-buttress teeth defined thereon, said teeth being symmetrical to both push and pull forces applied through the assembly by either the workstring or the liner conduit subsequent to setting within said casing string;

(4) wherein said assembly is moved to a set position relative to said casing string by application of hydraulic pressure in a first predeterminable determinable amount to transmit and apply a setting load to said slip elements;

(5) and further comprisng compressive biasing means movable to a compressed condition by mechanical manipulation of said workstring subsequent to movement of said assembly to said set position to transmit a second load to said slip elements in excess of the setting load; and (6) locking means for locking the setting and second loads into said slip assembly, (b) running said hanger assembly into the well on said workstring with a liner conduit carried at the lower end of said hanger assembly;

(c) positioning said hanger assembly within said casing string at a predetermined position; and (d) actuating said assembly to move said slip elements into gripping engagement with the casing string.

9. A method of positioning a casing liner within a casing string in a subterranean well, comprising the steps ofP (a) securing at the top of the well to a tubular workstring a liner hanger assembly, said assembly comprising:

(1) an elongated tubular housing;

(2) a series of circumferentially extending slip elements carried exteriorly around and by said housing and mvoable from a reatracted position to an expanded position for gripping engagement with the casing string;

(3) each of said slip elements hjaving circumferentially subscribed exterioly producing nonbuttress teeth defined thereon, said teeth being symmetrical to both push and pull forces appled through the assembly by either the work string or the liner conduti subsequent to setting withi said casing string, said teeth having top and bottom arches each offsed 90° from one anotherf and extending to a respective outer tip of each of said teeth, said teeth being at one end of said slip elemetns;

(4) clutch means at the other end of said slip elements for expansive engagement relative to said housign, said other end of said slip elements facing said liner conduit, said hanger assembly being moved to a set position relative to said casing string by application of hydraulic pressure in a first pre-deteeeerminable amount to transmit and apply a setting load to said slip elements;

(5) compressive biasing means movable to a compressed condition by mechanical manipulation of said workstring subsequent to movement of said assembly to said set position to transmit a second load to said slip elements in excess of the setting load;

(6) locking means for locking the setting and second loads into said slip assembly, said locking means comprising a one-way ratchdet assembly including a lock ring disposed exrteriorly around said housing with wickers thereon facing said housign for ratcheting engagement along companion wickers defined around the exterior of said housing;

(7) bearing means disposed and below said teeth to permit rotation ofsaid housing both above and below said teeth to permit rotation of said housing both above and below said teeth without rotation of said slip elemtnt subsequent to setting of said apparatus in said casing string.

10. The method of claim 9 further comprising the step of:

rotating the workstring in at least one of (f) said clockwise and counterclockwise directions to rotate said housing and said liner conduit without rotation of said slip elements.

11. A hanger assembly securable to a workstring for carrying a liner conduit in a subterranean well and settable within a casing string, said assembly comprising:

(1) an elongated tubular housing;

(2) series of circumferentially extending slip elements carried exteriorly around said housing and movable from a retracted position to an expanded position for gripping engagement with the casing string, said hanger assembly being moved to set position relative to said casing string by application of hydraulic pressure in a first pre-determinable amount to transmit and apply a setting load to said slip assembly; and (3) further comprising compressive biasing means movable to a compressed condition by mechanical manipulation of said workstring subsequent to movement of said assembly to said set position to transmit a second load to said slip elements in excess of the setting load, and locking means for locking the setting and second loads into said slip assembly.

12. The apparatus of claim 11 wherein said locking means comprises a one-way ratchet assembly including a lock ring disposed exteriorly around said housing with wickers thereon facing said housing for ratcheting engagement along companion wickers defined around the exterior of said housing.

13. A hanger assembly securable to a workstring for carrying a liner conduit in a subterranean well and settable within a casing string, said assembly comprising:

(1) an elongated tubular housing;

(2) series of circumferentially extending slip elements carried exteriorly around said housing and movable from a retracted position to an expanded position for gripping engagement with the casing string, said hanger assembly being moved to set position relative to said casing string by application of hydraulic pressure in a first pre-determinable amount to transmit and apply a setting load to said slip assembly;

(3) further comprising compressive biasing means movable to a compressed condition by mechanical manipulation of said workstring subsequent to movement of said assembly to said set position to transmit a second load to said slip elements in excess of the setting load, and locking means for locking the setting and second loads into said slip assembly; and (4) bearing means to permit rotation of said housing without rotation of said slip element subsequent to setting of said housing in said casing string.

* * * * *